US005115224A

United States Patent [19]

Kostusiak et al.

[11] Patent Number: 5,115,224

[45] Date of Patent: May 19, 1992

[54] PERSONAL SECURITY SYSTEM NETWORK

[75] Inventors: Karl H. Kostusiak, Pittsford; Daniel F. Pedtke, Palmyra; Todd E. Heckleman, Hamlin, all of N.Y.

[73] Assignee: Detection Systems, Inc., Fairport, N.Y.

[21] Appl. No.: 726,362

[22] Filed: Jul. 5, 1991

[51] Int. Cl.[5] ..... G08B 25/00

[52] U.S. Cl. ..... 340/574; 340/539; 340/825.45; 340/825.49; 455/57.1; 455/34.1

[58] Field of Search ..... 340/574, 539, 825.45, 340/825.49; 455/57, 34, 53, 49, 54

[56] References Cited

U.S. PATENT DOCUMENTS 4,764,757 8/1988 DeMarco et al. ..... 340/574
4,998,095 3/1991 Shields ..... 340/574
5,051,741 9/1991 Wesby ..... 340/539
5,055,851 10/1991 Sheffer ..... 340/539

*Primary Examiner*—Glen R. Swann, III

[57] ABSTRACT

A personal security system includes at least one movable transmitter adapted to produce an emergency signal transmission when activated and a plurality of transceivers adapted to receive emergency signal transmissions from the movable transmitter. The received strength of an emergency signal received by one of the transceivers is compared with the received signal strength of an emergency signal received by other of the transceivers, and an alarm signal is produced by a transceiver in response to receipt of a transmission whose signal strength is stronger than any other transmission signal strength to which it has been compared. The alarm signal may include a code identifying both the activated movable transmitter and the transceiver producing the alarm signal.

13 Claims, 1 Drawing Sheet

FIGURE 1
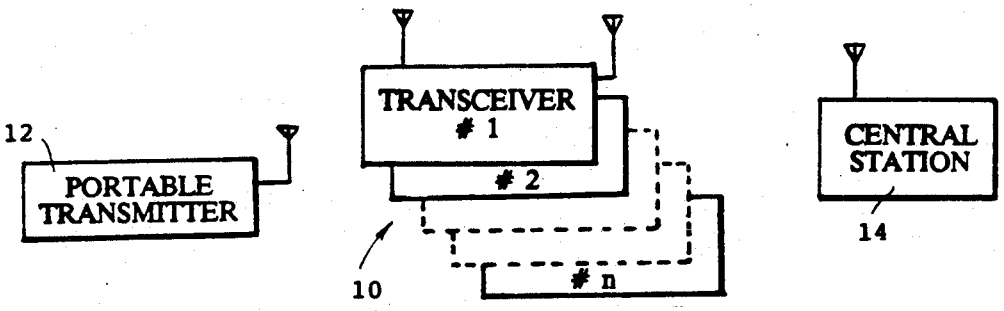
FIGURE 2
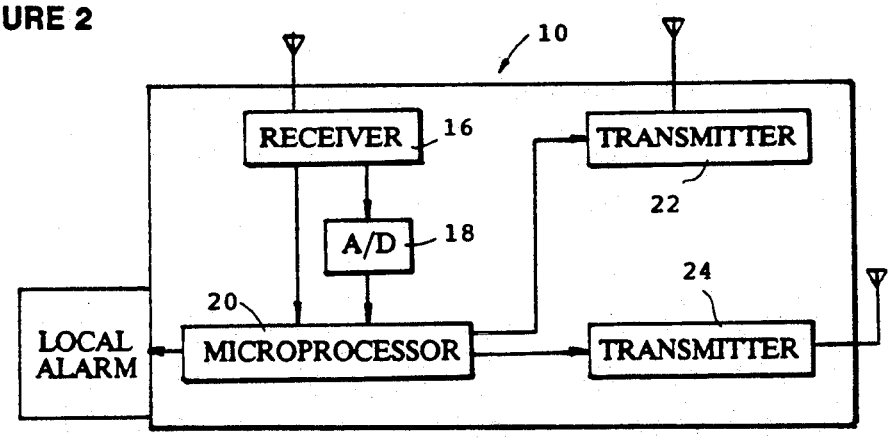
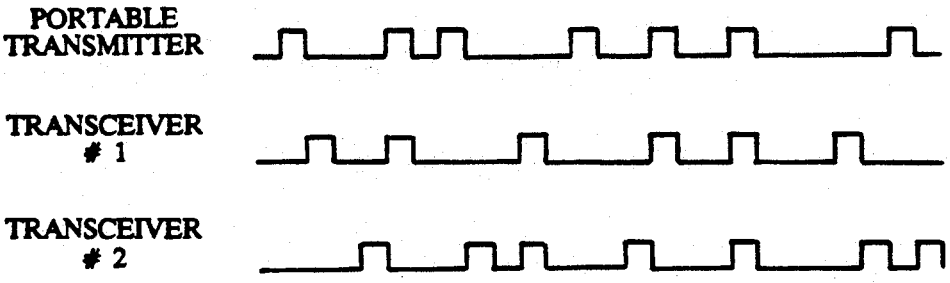
FIGURE 3

PERSONAL SECURITY SYSTEM NETWORK

BACKGROUND OF THE INVENTION

1. Field of the Invention

The present invention relates to a network of transceivers which monitor a defined geographic area for the receipt of transmissions indicative of emergency situations, and which relay an alarm signal to a central station for appropriate action. More particularly, the present invention is directed to an improved network of such transceivers wherein the location of the emergency situation is well defined when it is relayed to the central station.

2. Description of the Prior Art

Emergency transmitter systems are known in the art. U.S. Pat. No. 4,998,095, which issued to N. G. Shields on Mar. 5, 1991, describes an emergency transmitter system for individuals within a predetermined geographic area such as a campus, shopping mall, or stadium. A plurality of fixed transceivers at selected locations in the are monitor radio frequency emergency transmissions from portable transmitters. All transceivers that receive an emergency transmission produce a local alarm (strobe light, siren, or other audio alarm indicator) and transmit an alarm signal to a central station. The alarm signal includes the identity of the individual transmitter as well as the identity of the transceiver.

If an emergency transmission is received by more than one transceiver, each receiving transceiver will produce a local alarm and will transmit an alarm signal to the central station. Besides the disturbance factor of having many local alarms activated, security personal responding to the alarm are likely to be confused by the many activated alarms and therefore be less likely to locate the problem than if only the one closest transceiver was activated.

In the emergency transmitter system described in the Shields patent, transceiver locations are restricted to light poles and other similar structure where local electrical power is available. While battery operation might be considered, receipt of an emergency transmission by more than one transceiver, and the associated activation of the local alarms of each receiving transceiver, consumes additional battery life and makes battery operation less desirable.

SUMMARY OF THE INVENTION

It is an object of the present invention to provide a transceiver network of the type described wherein only the transceiver or transceivers closest to the portable transmitter which is producing an emergency signal transmission will be activated to produce a local alarm and to transmit an alarm signal to a central station.

It is another object of the present invention to provide communication between all transceivers that receive an emergency signal transmission, and to provide means for determining which of the transceivers received the strongest signal.

It is still another object of the present invention to provide for each transceiver to measure the amplitude of a received emergency signal transmission, to transmit a relay signal which includes the identity of the portable transmitter, the physical location of the transceiver, and the amplitude of the received emergency signal transmission.

It is yet another object of the present invention to provide transceivers with means to determine if the emergency signal transmission received is stronger or weaker than that received by other transceivers, and to emit an alarm signal only if it has received the strongest emergency signal transmission.

It is another object of the present invention to provide transceivers with means to determine if the emergency signal transmission received is stronger or weaker than that received by other transceivers by assigning a waiting period, from the time that a transceiver detects an emergency signal, determined inversely by the received signal strength; emitting an alarm signal upon expiration of the waiting period if no other transceiver has yet emitted an emergency alarm.

In accordance with these and other objects, the present invention provides a personal security system comprising at least one movable transmitter adapted to produce an emergency signal transmission when activated, a plurality of transceivers adapted to receive emergency signal transmissions from the movable transmitter, means for comparing the received strength of an emergency signal received by one of the transceivers with the received signal strength of an emergency signal received by other of the transceivers, and means for causing a transceiver to produce an alarm signal in response to receipt of a transmission whose signal strength is stronger than any other transmission signal strength to which it has been compared.

In one embodiment, the alarm signal includes a code identifying both the activated movable transmitter and the transceiver producing the alarm signal. The transceivers are fixed in a predetermined pattern within a geographic area, and the movable transmitters are portable within said geographic area. Comparison of received signal strength of emergency signals may be effected by assigning a waiting period before a transceiver produces an alarm signal based on the received signal strength; and preventing all but the first transceiver to transmit an alarm signal.

The emergency signal transmissions of the portable transmitters may be radio frequency signals to be received by all transceivers that are within radio range of an activated transmitter. The transceivers include a receiver adapted to produce a coded data signal and a received-signal-strength indication, and are adapted to produce a relay signal including the coded data signal and the received-signal-strength indication. The relay signal is approximately the same frequency as that used by the movable transmitter, with the addition of the received-signal-strength indication information. Suitable means are employed to avoid collisions between transmissions from other transmitters. For example, the transceiver transmitter may be adapted to randomly space multiple transmissions.

BRIEF DESCRIPTION OF THE DRAWINGS

In the detailed description of the preferred embodiment of the invention presented below, reference is made to the accompanying drawings, in which:

FIG. 1 is a schematic representation of a geographic area provided with the personal security system network of the present invention;

FIG. 2 is a block diagram of a fixed transceiver as shown in FIG. 1; and

FIG. 3 is a timing diagram of the personal security system network of FIG. 1.

DETAILED DESCRIPTION OF THE PREFERRED EMBODIMENT

Referring to FIG. 1, a personal security system network according to one embodiment of the present invention includes a plurality of fixed transceivers 10 located in a predetermined pattern within a geographic area, such as for example on utility poles, sides of buildings, etc. Also shown in FIG. 1 is a portable transmitter 12 that can be carried by a person and activated to produce a radio frequency emergency signal transmission to be picked up by the fixed transceivers. The signal strength of the emergency signal received by each transceiver 10 is generally inversely related to the distance of the transceiver from the portable transmitter. A central station receiver 14 monitors alarm signals from the transceivers, as explained in detail below.

The emergency signal transmission from an activated portable transmitter 12 is picked up by all transceivers 10 that are within radio range of the transmitter. Referring to FIG. 2, transceiver 10 includes a receiver 16 from which comes a digital coded data signal and an analog received-signal-strength indication (RSSI) which is converted to digital code by an analog-to-digital converter 18.

The two digital signals are combined by a microprocessor 20 into a serial stream for transmission as a relay signal via a transmitter 22 approximately the same frequency as that used by portable transmitters 12. This relay signal also includes the received-signal-strength indication (RSSI) information. Transceivers use this additional information to distinguish relay signals received from other transceivers from emergency signals received from portable transmitters.

Emergency signals transmitted from a portable transmitter are likely to reach more than one transceiver. Each receiving transceiver will transmit a relay signal, which combines the emergency signal with additional received-signal-strength indication (RSSI) information. The receiver in each transceiver receives this message from each transceiver as it receives messages from the movable transmitters. Now, the microprocessor in each transceiver will determine if the emergency signal just received from a portable transmitter is stronger or weaker than that received by another transceiver in the system. Any transceiver which determines that it has received the strongest emergency signal will go into an alarm state; activating the local alarm and initiating a message from a second transmitter 24. Transmitter 24 has a longer range than transmitter 22 so as to reach central station receiver 14. The alarm message includes (1) the code from the portable transmitter, (2) an amplitude code, and (3) a transceiver identification code.

According to a feature of the present invention, transmitter 24 can be eliminated. In this alternative embodiment, all transceivers in the system will automatically re-transmit any alarm signal and the identification of the originating transceiver with the strongest signal. The alarm signal will therefore propagate through the system, reaching central station receiver 14. To prevent the system from getting locked in a loop, each transceiver microprocessor 20 is programmed to not repeat a particular alarm message for a predetermined time period sufficiently long to let the system propogate efficiently to the central transceiver. Such logic is well within the ability of one of ordinary skill in the art. For example, the microprocessor might simply store a transmitted alarm message for a predetermined time, compare a received message to stored messages, and not re-transmit any stored messages.

Receivers can not receive two signals at the same time. Since all transceivers may be transmitting a relay signal at the same time, they may interfere with each other. Therefore, the present invention provides a scheme to randomly space multiple transmissions from the transceivers to avoid collisions between the transmissions. For example, each transceiver may send a relay signal multiple times with a random repetition rate that is, say, proportional to its identification code, to guarantee that there is at least one time period when the signal is transmitted without interference. FIG. 3 shows the transmission periods for a portable transmitter and two transceivers. Not that there are periods wherein only one transmitter is active.

In FIG. 3, each depicted transceiver transmission period is comprised of a plurality of bits. For example, each transmission period may contain a 38 bit movable transmitter address, a 5 bit movable transmitter signal amplitude signal, and a 16 bit transceiver identification signal.

Another method for the determination of which transceiver has received the strongest emergency signal when the signal is received by several transceivers will not be described. A clock in microprocessor 20 is initiated upon receipt of an emergency signal. The clock relates a time period to the signal amplitude by transposing the signal amplitude into a delay period. The analog amplitude of a received signal is converted to a digital number which is divided into a predetermined time delay. When the clock reaches the quotent value, an alarm signal is transmitted only if no alarm signal from another transmitter has, by that time, been received. Thus, only the transceiver receiving the strongest emergency signal will emit an alarm signal.

The invention has been described in detail with particular reference to preferred embodiments thereof, but it will be understood that variations and modifications can be effected within the spirit and scope of the invention.

What is claimed is:

1. A personal security system comprising:

at least one movable transmitter adapted to produce an emergency signal transmission when activated;

a plurality of transceivers adapted to receive emergency signal transmissions from the movable transmitter;

means for comparing the received strength of an emergency signal received by one of said transceivers with the received signal strength of an emergency signal received by others of said transceivers; and means for causing a transceiver to produce an alarm signal only in response to receipt of a transmission whose signal strength is at least as strong as any other received signal strength to which it has been compared.

2. A personal security system as set forth in claim 1 wherein said alarm signal includes a code identifying the transceiver producing the alarm signal.

3. A personal security system as set forth in claim 1 wherein said alarm signal includes a code identifying the activated movable transmitter and the transceiver producing the alarm signal.

4. A personal security system as set forth in claim 1 wherein:

said transceivers are fixed in a predetermined pattern within a geographic area; and said movable transmitters are portable within said geographic area.

5. A personal security system as set forth in claim 4 wherein said emergency signal transmissions of the portable transmitters are radio frequency signals to be received by all transceivers that are within radio range of an activated transmitter.

6. A personal security system as set forth in claim 5 wherein said transceivers include a receiver adapted to produce a coded data signal and a received-signal-strength indication.

7. A personal security system as set forth in claim 6 wherein said transceivers include a transmitter adapted to produce a relay signal including said coded data signal and said received-signal-strength indication.

8. A personal security system as set forth in claim 7 wherein said relay signal producing transmitter is adapted to produce the relay signal having the approximate same frequency as that of said movable transmitter.

9. A personal security system as set forth in claim 8 wherein said relay signal is identical to the transmission from the movable transmitter in terms of format, frequency, and power level, with the addition of the received-signal-strength indication information.

10. A personal security system as set forth in claim 3 further comprising a central station, and wherein said transceivers are adapted to re-transmit alarm signals received from other transceivers so as to propagate the alarm signal to said central station.

11. A personal security system as set forth in claim 3 further comprising a central station, and wherein said transceiver further includes a second transmitter having a longer transmitting range than the other transmitter in the transceiver so as to broadcast an alarm signal to the central station.

12. A personal security system as set forth in claim 3 wherein said transceiver transmitter is adapted to randomly space multiple transmissions to avoid collisions between transmissions from other transmitters.

13. A personal security system as set forth in claim 1 wherein said means for comparing the received strength of an emergency signal comprises:

means for causing each transceiver to transmit an alarm signal at the end of a respective time period following receipt of an emergency signal, said respective time period for each transceiver being inversely related to the strength of an emergency signal as received by the transceiver; and means for preventing transmission of an alarm signal by any but the first transceiver to do so.

* * * * *